US006979358B2

(12) United States Patent
Ekker et al.

(10) Patent No.: US 6,979,358 B2
(45) Date of Patent: Dec. 27, 2005

(54) VERTICAL CYCLONE SEPARATOR

(75) Inventors: Andreas Ekker, Amsterdam (NL); Cornelis Josephus Maria De Kort, Amsterdam (NL)

(73) Assignee: Shell Oil Company, Houston, TX (US)

( * ) Notice: Subject to any disclaimer, the term of this patent is extended or adjusted under 35 U.S.C. 154(b) by 158 days.

(21) Appl. No.: 10/416,081

(22) PCT Filed: Nov. 7, 2001

(86) PCT No.: PCT/EP01/13032

§ 371 (c)(1),
(2), (4) Date: May 6, 2003

(87) PCT Pub. No.: WO02/38279

PCT Pub. Date: May 16, 2002

(65) Prior Publication Data

US 2004/0237487 A1 Dec. 2, 2004

(30) Foreign Application Priority Data

Nov. 7, 2000 (EP) ..... 00203901

(51) Int. Cl.[7] ..... B04C 5/081
(52) U.S. Cl. ..... 55/345; 55/459.1; 95/271
(58) Field of Search ..... 55/345, 459.1; 95/271; 210/787, 512.1, 512.2

(56) References Cited

U.S. PATENT DOCUMENTS 1,023,082 A * 4/1912 Kluge ..... 55/345
3,052,361 A * 9/1962 Whatley et al. ..... 210/512.2
3,636,682 A 1/1972 Rush
4,097,381 A * 6/1978 Ritzler ..... 210/259
4,380,105 A 4/1983 MacLean et al.
4,713,096 A * 12/1987 Kajihara ..... 55/459.1
4,749,490 A * 6/1988 Smyth et al. ..... 210/512.1
5,221,299 A * 6/1993 Boring ..... 96/408
6,733,554 B2 * 5/2004 Ribera Salcedo ..... 55/338

FOREIGN PATENT DOCUMENTS

GB 668848 1/1949
WO 00/50538 8/2000

OTHER PUBLICATIONS

Fig 17-36 of Perry's Chemical Engineers' Handbook, McGraw Hill. 7th Edition. 1997.
Daniel DeCroocq. "Catalytic cracking of heavy petroleum fractions". Institut Francais du Petrole, 1984 (ISBN 2-7108-455-7). pp. 100-114.

* cited by examiner

*Primary Examiner*—Frank M. Lawrence
(74) *Attorney, Agent, or Firm*—Charles W. Stewart

(57) ABSTRACT

Vertical cyclone vessel having a tubular housing comprising of a tubular wall section provided with a tangentially arranged inlet for receiving a suspension of gas and solids and an elevated cover which closes the upper end of the tubular wall section, wherein a gas outlet conduit significantly protrudes from above and along the axis into the tubular housing to at most the horizontal position of the center of the tangentially arranged inlet.

15 Claims, 1 Drawing Sheet

VERTICAL CYCLONE SEPARATOR

The invention is directed to an improved cyclone separator. The invention is also directed to the use of such a cyclone in a fluid catalytic cracking process.

BACKGROUND OF THE INVENTION

Such a separator is described in WO-A-0050538. According to this publication a cyclone separator is disclosed which has an improved separation efficiency as compared to the conventional cyclone separators as exemplified in FIG. 17–36 of Perry's Chemical Engineers' handbook, McGraw Hill, 7 th ed., 1997.

SUMMARY OF THE INVENTION

The present invention aims at providing a separator having an even more improved separation efficiency as the cyclone separators disclosed in this PCT publication.

This object is achieved with the following cyclone separator. Vertical cyclone vessel having a tubular housing comprising of a tubular wall section provided with a tangentially arranged inlet for receiving a suspension of gas and solids and an elevated cover which closes the upper end of the tubular wall section, wherein a gas outlet conduit significantly protrudes from above and along the axis into the tubular housing to at most the horizontal position of the centre of the tangentially arranged inlet.

DETAILED DESCRIPTION

Figure 1:
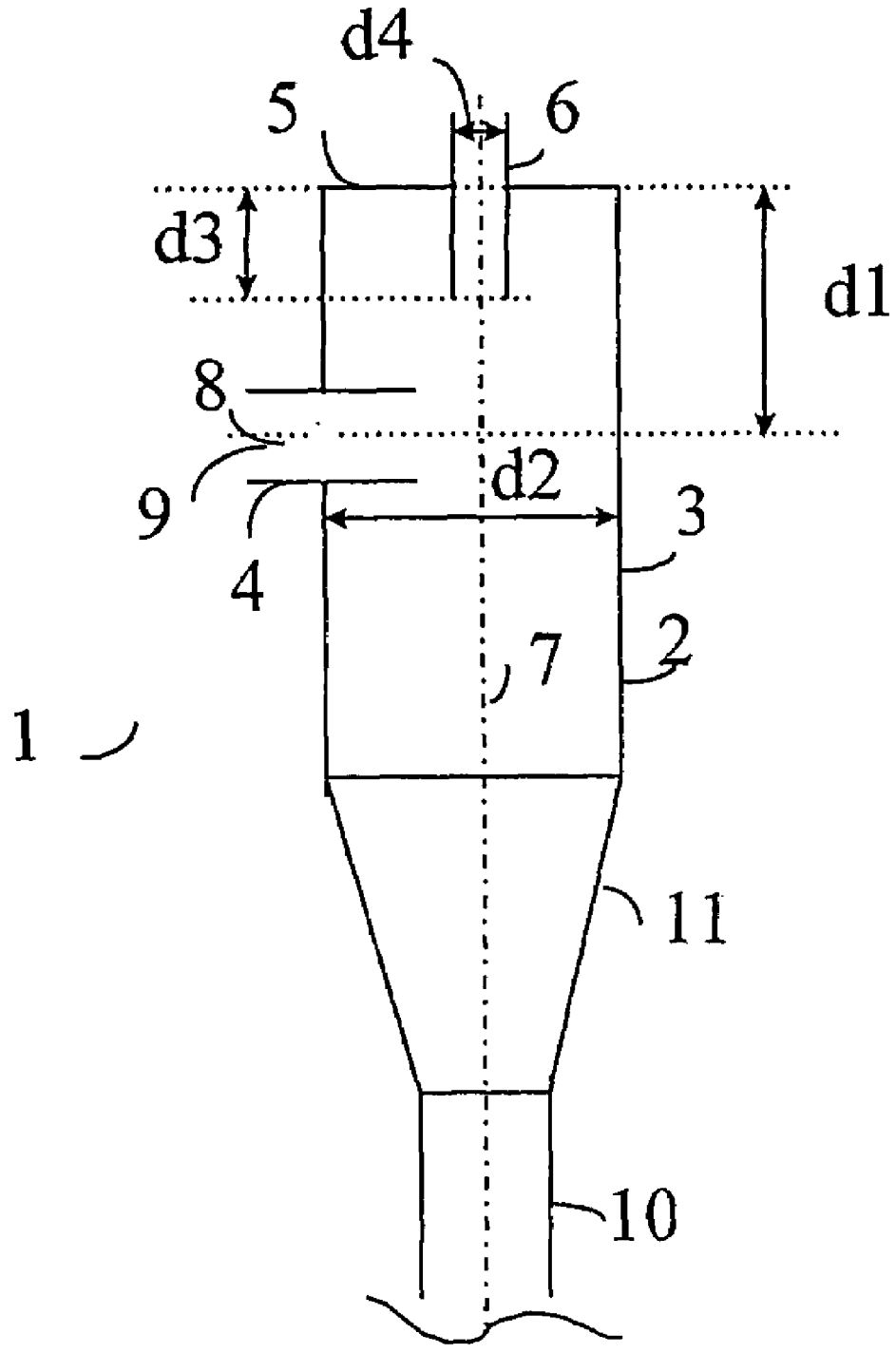
FIG. 1 is a schematic diagram illustrating the improved cyclone separator of the invention.

Applicants have found that the cyclone separator of the invention achieves an improved separation efficiency as compared to the cyclone separator of the state of the art, especially when the feed contains relatively high levels of solids.

The invention shall be described in more detail below, including some preferred embodiments.

The cover of the cyclone is elevated with respect to the tangentially arranged inlet for receiving a suspension of solids and gas. With elevated is here meant that the distance between the cover and the centre of the tangentially arranged inlet is greater than generally applied. Typical cyclones as illustrated in the prior art have a cover which is positioned just above the tangentially arranged inlet. Preferably the elevated cover is arranged at a vertical distance (d1) above the centre of the tangentially arranged inlet opening and wherein the ratio of this distance (d1) and the diameter of the tubular housing (d2) is between 0.2 and 3 and more preferably between 0.5 and 2 and most preferably between 0.5 and 1.5.

The gas outlet conduit protrudes significantly the tubular housing of the cyclone from above. With significantly protruding is meant that the protrusion distance (d3) as measured from the elevated cover into the tubular housing is at least 0.4 times greater than the diameter (d4) of the gas outlet conduit. Preferably greater than 0.5 the diameter (d4) of the gas outlet conduit. More preferably the ratio of distance (d3) and the distance (d1) between the elevated cover and the centre of the tangentially arranged inlet opening is between 0.1 and 0.6, more preferably between 0.4 and 0.6.

FIG. 1 illustrates a cyclone according to the present invention. FIG. 1 shows a vertical cyclone vessel (1) having a tubular housing (2) comprising of a tubular wall section (3) provided with a tangentially arranged inlet (4) for receiving a suspension of gas and solids and an elevated cover (5) which closes the upper end of the tubular wall section (3), wherein a gas outlet conduit (6) significantly protrudes from above and along the axis (7) into the tubular housing (2) to at most the horizontal position (8) of the centre (9) of the tangentially arranged inlet (4). The illustrated vertical cyclone according (1) is also provided with an optional dipleg (10) at the lower end of the tubular wall section (3), which dipleg (10) (partly shown) is fluidly connected to the tubular wall section by means of a frustoconical wall section (11). The figure also illustrates the distances d1, d2, d3 and d4 as used above.

The cyclone according to the invention can advantageously be used as a primary cyclone in combination with a secondary cyclone wherein the gas outlet conduit of the primary cyclone is fluidly connected to a tangentially arranged inlet of a secondary cyclone. The secondary cyclone can be a state of the art cyclone as for example disclosed in FIG. 17–36 of Perry's Chemical Engineers' handbook, McGraw Hill, 7 th ed., 1997.

The cyclone separator is used for separating solid particles from a suspension of particles and gas. The cyclone according to the invention can find use in any process in which solid particles are to be separated from a suspension of said solid particles and a gas. Examples of such process are the MTBE-fluidized bed dehydrogenation process, the acrylonitrile process and the fluid catalytic cracking (FCC) process. Examples of such a fluid catalytic cracking process are described in Catalytic Cracking of Heavy Petroleum Fractions, Daniel DeCroocq, Institut Francais du Petrole, 1984 (ISBN 2-7108-455-7), pages 100–114. Preferably the apparatus is used in an FCC process wherein a gas solids suspension if fed to the primary cyclone having a solids content of between 1 and 15 kg/m$^3$. Preferably the cyclone according to the present invention is used as the primary cyclone in the preferred embodiments as disclosed in WO-A-0050538 and especially those illustrated in FIGS. 1–5 of said publication.

The invention is also directed to a fluidized catalytic cracking reactor vessel wherein the downstream end of a reactor riser is in fluid communication with the tangentially arranged inlet of a cyclone according to the present invention, the vessel further comprising at its lower end a stripping zone provided with means to supply a stripping medium to a dense fluidized bed of separated catalyst particles, means to discharge stripped catalyst particles from the vessel and means to discharge the hydrocarbon and stripping medium vapours from the vessel.

The invention shall be illustrated with the following example.

EXAMPLE

To a cyclone separator having the design as in FIG. 1 a gas-solids suspension was fed having a dustload of 8 kg solids/kg gas. The average particle size of the solids was 50 micron. The inlet velocity of the suspension was 20 m/s. The diameter (d2) of the tubular housing was 0.300 m and the distance (d1) between the centre of the inlet and the elevated cover was 0.290 m, such that the ratio d1/d2 was 0.97. The gas outlet conduit had an internal diameter (d4) of 0.108 m. The remaining dimensions of the tubular part of the cyclone, the dipleg and the connecting part are of a conventional size.

The protrusion (d3) of the gas outlet was varied and the fraction solids which were not separated in the cyclone (i.e. solids fraction in overflow) was measured at the various values for d3. The results are presented in the below Table.

TABLE

| | d3/d1 | Solids fraction in Overflow (wt %) | Pressure drop (Pa) |
|---|---|---|---|
| 1 | 0 | 0.3 | 2002 |
| 2 | 0.19 | 0.1 | 2037 |
| 3 | 0.65 | 0.2 | 2110 |

What is claimed is:

1. A vertical cyclone vessel having a tubular housing comprising of a tubular wall section provided with a tangentially arranged inlet for receiving a suspension of gas and solids and a cover which closes the upper end of the tubular wall section, wherein a gas outlet conduit protrudes from above and along the axis into the tubular housing to at most the horizontal position of the center of the tangentially arranged inlet, wherein the cover is arranged at a vertical distance (d1) above the center of the tangentially arranged inlet opening and wherein the ratio of this distance (d1) and the diameter of the tubular housing (d2) is between 0.5 and 2 and wherein the gas outlet conduit protrudes at least distance (d3) as measured from the cover into the tubular housing and wherein the ratio of this distance (d3) and the distance (d1) between the elevated cover and the center of the tangentially arranged inlet opening is between 0.1 and 0.6, wherein the ratio of the distance (d1) and the diameter of the tubular housing (d2) is between 0.5 and 1.5, wherein the gas outlet conduit protrudes at least distance (d3) as measured from the elevated cover into the tubular housing, wherein the ratio of the distance (d3) and the diameter (d4) of the gas outlet conduit is at least 0.4, and wherein a dipleg is present at the lower end of the tubular wall section of the vertical cyclone, which dipleg is fluidly connected to the tubular wall section by means of a frustoconical wall section.

2. A separation apparatus comprising a cyclone separator according to claim 1 as a primary cyclone wherein the gas outlet conduit is fluidly connected to a tangentially arranged inlet of a secondary cyclone for receiving a suspension of gas and solids.

3. A fluidized catalytic cracking reactor vessel wherein the downstream end of a reactor riser is in fluid communication with the tangentially arranged inlet of a cyclone according to claim 1 wherein the vessel further comprises at its lower end a stripping zone provided with means to supply a stripping medium to a dense fluidized bed of separated catalyst particles, means to discharge stripped catalyst particles from the vessel and means to discharge the hydrocarbon and stripping medium vapours from the vessel.

4. A cyclone separator system, comprising:

a primary cyclone vessel, comprising:

a tubular wall section defining a tubular housing having a tubular housing diameter (d2), an axis and an upper end and further which is provided with a first tangentially arraigned inlet for receiving a first suspension of gas and solids, wherein said first tangentially arranged inlet has a horizontal position defined by a center line;

a cover that closes said upper end of said tubular wall section; and a gas outlet conduit that protrudes from above said upper end and extends along said axis into said tubular housing to at most said center line of said first tangentially arraigned inlet, wherein said cover is arranged at a vertical distance (d1) above said center line of said first tangentially arranged inlet, and wherein the ratio of said vertical distance (d1) and said tubular housing diameter (d2) is between 0.2 and 3, and wherein said gas outlet conduit protrudes to at least a protrusion distance (d3) as measured from said cover into said tubular housing, and wherein the ratio of said protrusion distance (d3) and said vertical distance (d1) is between 0.1 and 0.6; and a secondary cyclone vessel equipped with a second tangentially arraigned inlet for receiving a second suspension of gas and solids, wherein said gas outlet conduit of said primary cyclone vessel is fluidly connected to said second tangentially arraigned inlet of said secondary cyclone vessel.

5. A cyclone separator system as recited in claim 4, wherein said gas outlet conduit is defined by having a gas outlet conduit diameter (d4), and wherein the ratio of said protrusion distance (d3) and said gas outlet conduit diameter is at least 0.4.

6. A cyclone separator system as recited in claim 5, wherein said cyclone separator system is integrated with an FCC system that comprises an FCC system vessel, a reactor riser having a downstream end, means for supplying a stripping medium to a dense fluidized bed of separated catalyst particles contained within said FCC system vessel, means for discharging stripped catalyst particles from said FCC system vessel, and means for discharging hydrocarbon and said stripping medium from said FCC system vessel, wherein said downstream end of said reactor riser is in fluid communication with said first tangentially arraigned inlet.

7. A cyclone separator system as recited in claim 6, wherein the ratio of said vertical distance (d1) and said tubular housing diameter (d2) is between 0.5 and 2.

8. A cyclone separator system as recited in claim 7, wherein the ratio of said protrusion distance (d3) and said vertical distance (d1) is between 0.4 and 0.6.

9. A method of separating solid particles from a suspension of particles and gas generated from a reactor riser of an FCC system, wherein said method comprises:

providing a cyclone separator system comprising a primary cyclone vessel that comprises a tubular wall section defining a tubular housing having a tubular housing diameter (d2), an axis and an upper end and further which is provided with a first tangentially arraigned inlet for receiving said suspension of particles and gas, wherein said first tangentially arraigned inlet has a horizontal position defined by a center line; a cover that closes said upper end of said tubular wall section; and a gas outlet conduit that protrudes from above said upper end and extends along said axis into said tubular housing to at most said center line of said first tangentially arraigned inlet, wherein said cover is arranged at a vertical distance (d1) above said center line of said first tangentially arranged inlet, and wherein the ratio of said vertical distance (d1) and said tubular housing diameter (d2) is between 0.2 and 3, and wherein said gas outlet conduit protrudes to at least a protrusion distance (d3) as measured from said cover into said tubular housing, and wherein the ratio of said protrusion distance (d3) and said vertical distance (d1) is between 0.1 and 0.6; and utilizing said cyclone separator system by introducing said suspension of particles and gas into said primary cyclone vessel through said first tangentially arraigned inlet which is in fluid communication with said reactor riser.

10. A method as recited in claim 9, wherein said suspension of particles and gas has a solids content of between 1 and 15 $kg/m^3$.

11. A method as recited in claim 10, wherein said gas outlet conduit is defined by having a gas outlet conduit diameter (d4) and wherein the ratio of said protrusion distance (d3) and said gas outlet conduit diameter is at least 0.4.

12. A method as recited in claim 11, wherein said cyclone separator system further comprises a secondary cyclone vessel equipped with a second tangentially arraigned inlet for receiving a second suspension of gas and solids from said primary cyclone vessel, wherein said gas outlet conduit of said primary cyclone vessel is fluidly connected to said second tangentially arraigned inlet of said secondary cyclone vessel.

13. A method as recited in claim 12, wherein the ratio of said vertical distance (d1) and said tubular housing diameter (d2) is between 0.5 and 2.

14. A method as recited in claim 13, wherein the ratio of said protrusion distance (d3) and said vertical distance (d1) is between 0.4 and 0.6.

15. A method as recited in claim 14, wherein said FCC system that is integrated with said cyclone separator system comprises, in addition to said reactor riser that has a downstream end, an FCC system vessel, means for supplying a stripping medium to a dense fluidized bed of separated catalyst particles contained within said FCC system vessel, means for discharging stripped catalyst particles from said FCC system vessel, and means for discharging hydrocarbon and said stripping medium from said FCC system vessel, wherein said downstream end of said reactor riser is in fluid communication with said first tangentially arraigned inlet.

* * * * *